US006355392B1

(12) United States Patent
Yoon

(10) Patent No.: US 6,355,392 B1
(45) Date of Patent: Mar. 12, 2002

(54) METHOD OF PRODUCING TONER BY WAY OF DISPERSION POLYMERIZATION FOR USE IN DEVELOPING LATENT ELECTROSTATIC IMAGES

(75) Inventor: Hyun-Nam Yoon, Towaco, NJ (US)

(73) Assignee: MatSci Solutions, Inc., Towaco, NJ (US)

( * ) Notice: Subject to any disclaimer, the term of this patent is extended or adjusted under 35 U.S.C. 154(b) by 0 days.

(21) Appl. No.: 09/634,467

(22) Filed: Aug. 7, 2000

(51) Int. Cl.[7] ..... G03G 5/00

(52) U.S. Cl. ..... 430/137.15; 430/137.16; 430/108.1; 430/109.4; 430/110.4

(58) Field of Search ..... 430/137.15, 137.16, 430/108.1, 109.4, 110.4

(56) References Cited

U.S. PATENT DOCUMENTS 4,880,432 A * 11/1989 Egan et al. ..... 8/647
6,001,524 A 12/1999 Yoon et al. ..... 430/137

FOREIGN PATENT DOCUMENTS

GB 1373531 11/1974

OTHER PUBLICATIONS

Pajgrt, O. et al, "Processing of Polyester Fibres" in Textile Science and Technology 2, 1979, p. 40.

Po', R., "Poly(ethylene Terephthalate) (Modified with Ionic Groups)" in Polymeric Materials Encyclopedia, vol. 8, J. Salamone editor, CRC Press, 1996, pp. 6100–6105.

* cited by examiner

*Primary Examiner*—Mark Chapman
(74) *Attorney, Agent, or Firm*—Susan P. Petraglia

(57) ABSTRACT

A process for preparing a dispersion polymerized color toner for developing latent electrostatic images includes polymerization of a macromer in a liquid organic medium in which the macromer or the resulting polymer resin is not soluble. The liquid organic medium comprises a polymeric dispersion stabilizer. A macromer mixture comprising macromer, a colorant and a charge control agent may be polymerized in the dispersed state to produce the toner. Alternatively, the macromer is polymerized in the dispersed state to produce a particulate polymer resin. The particulate polymer resin formed is a functionalized resin having sites suitable for interacting with functionalized dyes that have complementary functionality. The functionalized dye is then applied to the resin particles typically with a dyeing aid, or surfactant. Toners produced by the inventive processes are substantially free of contamination by the liquid organic medium used during dispersion polymerization and/or dispersion dyeing.

38 Claims, No Drawings

METHOD OF PRODUCING TONER BY WAY OF DISPERSION POLYMERIZATION FOR USE IN DEVELOPING LATENT ELECTROSTATIC IMAGES

FIELD OF THE INVENTION

The invention relates to a method of producing a toner by a dispersion polymerization process, the toner being useful for developing latent electrostatic images in electrophotography and electrostatic printing. More specifically, the invention relates to a method of producing small resin particles comprising coloring agents and other additives, whereby the particles produced are substantially free of contaminants, such as the dispersion solvent used in the polymerization process. The toners thus produced are useful for high-resolution color electrophotography and electrostatic printing.

BACKGROUND OF THE INVENTION

The formation and development of images on the surface of photoconductive materials by electrostatic means is well known. The basic electrophotographic imaging process (disclosed in U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or overcoating treatment.

Toners and developer compositions including colored particles are well known. Examples in the U.S. patent art include U.S. Pat. Nos. 5,352,521, 4,778,742, 5,470,687, 5,500,321, 5,102,761, 4,645,727, 5,437,953, 5,296,325 and 5,200,290. The traditional compositions typically contain toner particles consisting of a resin and colorants, wax or a polyolefin, charge control agents, flow agents and other additives. A typical toner formulation generally contains about 90–95 weight percent resin, about 2–10 weight percent colorant, 0-about 6 weight percent wax, 0-about 3 weight percent charge control agent, 0-about 3 weight percent flow agent and 0-about 1 weight percent other additives. The resins most frequently used are styrene-acrylic copolymers, styrene-butadiene copolymers and polyesters. The colorants usually are selected from black dyes and pigments, cyan dyes or pigments, magenta dyes or pigments, yellow dyes or pigments, and mixtures thereof.

Conventional color toners are produced by a milling process described, for example, in the afore-mentioned U.S. Pat. No. 5,102,761. In that process, a polyester resin is compounded with pigments, charge control agents (henceforth, abbreviated "CCA") and occasionally, with wax, in a melt mixer. The resulting polymer mixture is mechanically crushed and then milled into small particles. The conventional toner particles typically have an irregular shape and a broad distribution in particle size. For optimum resolution of images and color, smaller particles perform better. Thus, for example, it is difficult to obtain resolutions better than about 600 dots/inch when the average particle size is larger than about 7 $\mu$m. For resolutions in the order of about 1200 dots/inch, particle sizes smaller than 5 $\mu$m are desirable. It is difficult to make particles smaller than about 7–10 $\mu$m by conventional processes because of the high energy cost of producing small particles as well as uniform narrow particle size distribution.

Improvements to cure such deficiencies have been attempted in the past. For example, the afore-mentioned U.S. Pat. Nos. 5,352,521, 5,470,687 and 5,500,321 disclose toner particles produced by dispersion polymerization processes. In the respective methods of those patents, monomers (typically styrenic and acrylate monomers) and additives such as pigments, CCA and wax are mixed together to form an initial dispersion. The initial dispersion is then further dispersed into an aqueous or a non-aqueous medium and the monomers are polymerized to form toner particles. The resultant toner particles, however, are deficient in uniform distribution of colorants, produce unacceptable transparency of the images formed, and have a high cost of production. Moreover, these processes are not useful to prepare polyester-based toner particles which, due to their superior compatibility with pigments, are preferred over particles based on styrenic or acrylic polymers.

Another example of improvement in the production of toner particles is provided in U.S. Pat. No. 6,001,524 which discloses small polyester toner particles produced by dispersion polymerization. In this method, polyester monomers together with a surfactant are dispersed into a non-aqueous medium and are polymerized to form small polyester particles. Dyes and CCA are then incorporated into the particles to form toner particles. One advantage of the dyed toner over the pigmented toner is that the former provides increased color fidelity as the dyes can be molecularly dispersed in the toner resins.

Dispersion polymerized toners represent a substantial improvement over milled toners in that the former can be made economically to have particle size smaller than 7 $\mu$m. However, the dispersion polymerized toners of the prior art nonetheless suffer from significant contamination problems. In the case of a condensation-type polymer resin such as a polyester resin, the dispersion polymerized particles are often contaminated with the dispersion medium. A condensation polymerization typically entails a significant volume reduction because the reaction proceeds with outward diffusion of reaction by-products from the reaction mixture. The volume reduction typically reaches about 50% of the monomer volume. The volume reduction, coupled with the fact that the condensation polymerization proceeds mostly in the surface region of the particles, often produces polyester particles with the dispersion solvent entrapped in the interior region of the particles or with capillary-like defects. The entrapped dispersion medium is difficult to eliminate from the particles by conventional purification processes. Images printed with toners containing a liquid contaminant often are "foggy" and are unacceptable for high-resolution printing.

There is continuing interest in, and need for the development of new and improved methods of producing toners for application in high-resolution color electrophotography.

Accordingly, an object of the present invention is to provide a method of producing high-resolution color toner which is free of afore-mentioned contaminants, using a novel dispersion polymerization of reactive oligomers (hereinafter also referred to as "macromer(s)") to form resin particles characterized by small size and a narrow particle size distribution. The ability to control the size parameter of and contamination level within small resin particles by resort to the instant dispersion polymerization of functionalized macromers is an important aspect of the invention. Other objects and advantages of the present invention shall become apparent from the accompanying description and examples.

SUMMARY OF INVENTION

One embodiment of the present invention is a process of preparing a functional oligomer ("macromer") suitable for forming a particulate toner resin by a melt or solution polymerization process. The macromer may contain functional sites suitable for interacting with functionalized colorants selected from the group consisting of: hydroxyl moieties; alkoxyl moieties; sulfonic or derivatized sulfonic moieties; sulfinic or derivatized sulfinic moieties; carboxyl or derivatized carboxyl moieties; phosphonic or derivatized phosphonic moieties; phosphinic or derivatized phosphinic moieties; thiol moieties, amine moieties; alkyl amine moieties; quaternized amine moieties; and mixtures thereof.

Another embodiment of the present invention is a process of producing a pigment-containing toner for developing latent electrostatic images. This is accomplished by dispersing a colorant, and one or more toner additives at least one of which is a charge control agent, in the macromer and forming a dispersion of the macromer-additive mixture in a liquid organic medium in the presence of a dispersion assisting surfactant. The organic medium is chosen such that the macromer or a resulting polymer is substantially insoluble in the organic medium. Polymerization of the macromer proceeds by maintaining the organic medium containing the macromer dispersion at an elevated temperature for a time sufficient to form a polymer with a molecular weight suitable for a toner application. The polymerized, pigmented particles are separated from the organic medium, with the former being substantially free of contamination from the dispersion medium or residual monomers.

Yet another embodiment of the invention is the preparation of small, functionalized, polymeric (or resin) particles from the dispersion polymerization of macromer as described in the preceding embodiment, whereby the particles formed are characterized by having small mean particle size and narrow particle size distribution, having an average degree of polymerization in the range of about 10 to about 100, and having substantially no contamination from (i.e., no entrapment of) the dispersion medium used in the polymerization process. Essential to obtaining resin particles with these favorable characteristics, in addition to the starting macromer, is the liquid organic medium used for the dispersion polymerization process. As described in further detail below, the organic medium is comprised of an organic solvent, having specified solubility parameter relative to the starting macromer, and a surfactant as a dispersion aid.

In yet another embodiment of the invention a process for producing a dispersion-dyed toner is provided. The process comprises forming the aforesaid resin particles, without incorporating a pigment in the initial macromer dispersion, and then subjecting the particles to a dispersion dyeing process, such as the process disclosed in pending U.S. patent application Ser. No. 09/457,543, the contents of which is incorporated herein by reference. According to the dispersion dyeing process as disclosed in the '543 application, a functionalized dye is applied to the present dispersion-polymerized resin particles containing functionally reactive moieties, and the particle size of the particulate polymer resin is substantially unchanged during the dyeing process. The toner thus produced is substantially free of contamination from the dispersion medium or residual monomers.

Further provided by the present invention is a developer composition comprising the dispersion-polymerized color toner of the present invention in conjunction with a suitable carrier. More particularly, carrier particles such as those exemplified in U.S. Pat. No. 5,693,444, ferrite particles, steel powder, iron powder, and optionally having a surface active agent coated thereon are applicable.

Toner compositions formed from the presently described dispersion-polymerized, functionalized macromer and containing one or more customary toner additives for optimizing toner performance, e.g., charge control agents, flow improvement agents (e.g., fumed silica), waxes, and other toner additives as are readily appreciated by those skilled in the art, also form a part of the invention.

DETAILED DESCRIPTION OF THE PREFERRED EMBODIMENTS

While resins such as copolymers of styrene and acrylate, copolymers of styrene and butadiene, and polyesters are conventional for preparing toner particles for thermal image fixing, polyesters are preferred for color toner applications because of their superior compatibility with colorants and adhesion to various printing substrates.

The polyesters suitable to be converted to toner particles have repeat units of the general formula:

$$-[P^1]_a-[P^2]_b-[P^3]_c-$$

where $P^1$ is a monomer moiety representing residues of a dicarboxylic acid moiety, $P^2$ is a monomer moiety representing residues of a diol moiety, and $P^3$ is a monomer moiety representing residues of a hydroxycarboxylic acid moiety. The units a, b, and c represent mole percent of the respective monomeric moiety, with a and b are independently equal to 1–50 mole percent, and c equals 0–98 mole percent.

The dicarboxyl component forming $P^1$ is selected from a variety of sources such as, for example, carboxylic acids, acid chlorides, esters and the like, as is well known to those skilled in the art. Examples of such dicarboxylic moieties suitable for $P^1$ include, but are not limited to, terephthalic acid, isophthalic acid, fumaric acid, succinic acid, glutaric acid, adipic acid, sebacic acid, cyclohexane dicarboxylic acid, naphthalene dicarboxylic acid, 1,2-bis(4-carboxyphenoxy)ethane, and combinations thereof. The diol component forming the $P^2$ part of the polyester is selected from a variety of diol sources. Examples of suitable diol moieties include, but are not limited to, ethylene glycol, isomers of propylene glycol, isomers of butylene glycol, isomers of pentane diol, isomers of hexane diol, isomers of cyclohexane dimethanol, 2-methyl-1,3-propanediol, 5-neopentyl glycol, bisphenol A-ethylene oxide condensate, bisphenol A-propylene oxide condensate and combinations thereof.

The hydroxycarboxylic acid component $P^3$ is derived from monomers derived from, for example, glycolic acid, lactic acid, caprolactone, γ-butyrolactone, β-butyrolactone, propiolactone, hydroxypivalic acid, lactone of hydroxypivalic acid, and combinations thereof.

Furthermore, the resins, suitable for the inventive process, may optionally contain one or more reactive functionalities in about 1–10 mole percent amounts. The reactive functionalities are chosen to be reactive toward suitable colorants either by a covalent bonding or by ionic complexing mechanism. The polyesters containing the reactive functionalities have repeat units of the general formula:

$$-[P^1]_a-[P^2]_b-[P^3]_c-[P^4]_d-$$

where $P^1$ is a monomer moiety representing residues of a dicarboxylic acid moiety, $P^2$ is a monomer moiety representing residues of a diol moiety, $P^3$is a monomer moiety representing residues of a hydroxycarboxylic acid moiety and $P^4$ is a monomer moiety carrying functionalities that are suitable for enhancing the resin's affinity to a colorant. The units a, b, c and d represent mole percent of the respective monomeric moiety, with a and b independently being equal to 1–50 mole percent, c equals 0–98 mole percent and d equals 1–10 mole percent.

Examples of the functional groups carried by the $P^4$ monomer moiety include, but are not limited to, the moieties hydroxyl, alkoxy, sulfonic or derivatized sulfonic, sulfinic or derivatized sulfinic, carboxyl or derivatized carboxyl, phosphonic or derivatized phosphonic, phosphinic or derivatized phosphinic, thiol, amine, alkylamine and quaternized amine and combinations thereof; for example, the moieties $-SO_3M$, —O—COOM, $-P(=O)(OM)_2$, $-P(=O)R(OM)$, —OH, —OR, $-\ominus NR_1R_2R_3$, and —SH, where R, $R_1$, $R_2$ and $R_3$ are lower alkyl groups, and M is a metal group.

The monomer unit $P^4$ which carries functionalities is a monomer which is capable of reacting with the other monomers to form a polyester and therefore may be a dicarboxylic acid moiety or a diol moiety or a hydroxycarboxylic acid moiety, wherein the functionality to later react with a coloring agent is covalently bonded. If, for example, $P^4$ is a diol the mole percent of the other diol component $P^2$ is adjusted so that the total diol mole percent from $P^2$ and $P^4$ will equal that of $P^1$. Conversely, if $P^4$ is a dicarboxylic moiety carrying the reactive functionalities, then the mole percent of the other dicarboxylic acid moiety $P^1$ is suitably adjusted such that the total dicarboxylate from $P^1$ and $P^4$ is equal to the diol component $P^2$. Similarly, when $P^4$ is a hydroxy carboxylic acid moiety, the amount of $P^3$ is adjusted correspondingly.

The macromers of the present invention are reactive polyester oligomers with the number averaged degree of polymerization in the range between 5–20, preferably, 7–15. Various known methods can be employed to produce the macromers from the polyester monomers just described. A preferred process is a melt condensation polymerization process. For example, using that process, methyl esters of the monomers containing carboxyl groups, such as dimethyl terephthalate, are reacted at about 150° C. with the monomers containing hydroxyl groups, such as 1-methyl-ethylene glycol, in the presence of an ester exchange catalyst, such as titanium tetra-isopropoxide, to form an ester exchanged polyester monomer. Polymerization is effected by subjecting the monomer to a higher temperature of about 240° C. and inducing glycolysis, i.e., the splitting off of glycol moieties from the polymerizing species. The degree of polymerization is controlled by monitoring the amount of glycol collected during the reaction and stopping the reaction by decreasing the reactant temperature when the collected volume of glycol reaches a value in the range of about 86 to 95% of the theoretical maximum value of the glycol. The reaction mixture is cooled down to ambient temperature to obtain solid macromer.

Small toner particles according to the invention comprising pigments and CCA, and which are substantially free of contamination, are produced by dispersion polymerization of the afore-described macromers. A pigmented toner is produced by dispersing a pigment and optional additives such as a charge control agent in the polyester macromer in the molten state; cooling the molten dispersed mixture until it solidifies; pulverizing the compounded macromer into coarse particles; preparing an organic medium bath comprising a mixture of an organic solvent and a surface active agent, such that the solvent does not dissolve the macromer or the resulting resin; dispersing the macromer particles in the bath; maintaining the dispersion at an elevated temperature of about 150° C. or higher and under vigorous shearing for an extended period of time until the average diameter of macromer particles reaches an equilibrium value determined by the amount of the surfactant; increasing the bath temperature to about 230° C. to effect polymerization of the droplets of the macromers; and cool the bath to ambient temperature and remove the organic solvent from the dispersion.

Commonly known pigments may be used as the colorant in the present toner particles. Illustrative black pigments may include carbon black, aniline black, non-magnetic ferrite and magnetite. Illustrative cyan pigments may include copper phthalocyanine compounds and derivatives thereof; anthraquinone compounds, and basic dye chelate compounds. Particularly preferred cyan pigments are C. I. Pigment Blue 1, 7, 151, 152, 153, 154, 60, 62, and 66. Illustrative magenta pigments may include condensation azo compounds, diketopyropyrrole compounds, anthraquinone compounds, quinacridone compounds, basic dye chelate compounds, naphthol compounds, benzimidazole compounds, thioindigo compounds and perylene compounds. Particularly preferred magenta pigments are C. I. Pigment Red 2, 3, 5, 6, 7, 23, 482, 483, 484, 811, 122, 146, 166, 169, 177, 184, 185, 202, 206, 220, 221, and 254. Illustrative yellow pigments may include condensation azo compounds, isoindolinone compounds, anthraquinone compounds, azo metal complexes, methine compounds, and allylamide compounds. Particularly preferred yellow pigments are C. I. Pigment Yellow 12, 13, 14, 15, 17, 62, 74, 83, 93, 94, 95, 109, 110, 111, 128, 129, 147, 168 and 180.

The colorants are selected taking into account the hue, chroma, brightness, weatherability, transparency and dispersibility in toner resins. The colorants may be used alone, in the form of a mixture, or in the state of a solid solution. Further, the colorant particles may be coated with a polymer film to facilitate dispersion of the particles in toner resins. The colorants may be added in the amount of from 1 to 20 parts by weight based on 100 parts by weight of the resin.

There are various known and effective positive or negative CCA that are suitable for incorporation into the toner compositions of the present invention. Preferably the CCA is present in an amount of from about 0.1 to about 10, more preferably from about 1 to about 3, percent by weight. Non-limiting examples of suitable CCA for inclusion in the present toner particles include quaternary ammonium compounds inclusive of alkyl pyridinium halides, alkyl pyridinium compounds, (e.g., U.S. Pat. No. 4,298,672, the disclosure of which is incorporated herein by reference); organic sulfate and sulfonate compositions, (e.g., U.S. Pat. No. 4,338,390, the disclosure of which is incorporated herein by reference); bisulfonates; ammonium sulfates (DDAES); distearyl dimethyl ammonium bisulfate (DDAMS), (e.g., U.S. Pat. No. 5,114,821, the disclosure of which is incorporated herein by reference); cetyl pyridinium tetrafluoroborates; distearyl dimethyl ammonium methyl sulfate, aluminum salts, such as Bontron® E84 or E88 (Oriental Chemicals); quaternary ammonium nitrobenzene sulfonates; and mixtures of charge enhancing additives, such as, e.g., DDAMS and DDAES. Other known charge additives readily appreciated by those skilled in the art are also useful herein.

In a preferred embodiment of the invention, it is preferable that the amount of the CCA is from about 0.1 to 10 parts by weight to 100 parts by weight of the resin particles for appropriately controlling the triboelectric charging characteristics of the toner particles and image fixing performance. However, the above ratio can be varied, depending upon the charge quantity required for the toner particles or the development means used with the toner particles.

Also, included as an additive to the toner compositions of the present invention are low molecular weight waxes, such as polypropylenes and polyethylenes (e.g., Epolene® N-15 commercially available from Eastman Chemical Products, Inc.), and similar waxes. Commercially available polyethylenes suitable in the practice of the invention are selected to have a molecular weight of from about 1,000 to about 1,500, while the commercially available polypropylenes have a molecular weight of from about 4,000 to about 7,000. The low molecular weight wax component is present in the toner composition in an amount of from 0 percent by weight to about 15 percent by weight, and preferably in an amount of from 0 percent by weight to about 10 percent by weight.

With respect to uniformly dispersing and blending the resins, colorants and charge control agents, conventionally known methods, such as melt-kneading in a sealed kneader and melt-mixing in a double screw extruder can be used. The kneaded or blended mixture, after cooling, may be pulverized to form coarse particles with the average size in the order of 100 microns using a ball mill, a hammer mill or an air jet mill.

In order to prepare toner particles with small mean particle size and narrow particle size distribution, the dispersion polymerization method as disclosed, e.g., in British Patent 1,373,531 (dispersion polymerization of polyester monomers) is suitable. The disclosure of the British '531 patent is incorporated herein in its entirety by reference. Generally, in a typical dispersion polymerization process, polymerizable monomers, an initiator and a dispersion stabilizer are dispersed in a solvent which is immiscible with the monomers. Under vigorous shearing, the monomers are finely dispersed as small droplets in the solvent and the droplets are stabilized without coalescence by the presence of the stabilizer molecules on their surface. The dispersion is then heated to an initiation temperature and the polymerization proceeds in each droplet. After a specified polymerization period, the reaction mixture is cooled to ambient temperature and polymer particles are separated by filtration for further processing.

However, in the course of the polymerization, each droplet undergoes a significant volume reduction, as much as 50% of the monomer volume, and ultimately, the toner particles made therefrom tend to contain a substantial amount of the dispersion solvent, on the order of about 5% of the particle volume. Toner particles containing entrained oil produce an unpleasant odor during a printing operation, as well as produce inferior printed images that are "foggy".

Applicant has found that a polyester macromer of the above-described degree of polymerization surprisingly forms a dispersion of fine droplets in a solvent which is immiscible with the macromer in spite of its high viscosity and further undergoes polymerization in the dispersed state. Even more surprisingly is that the resulting toner particles are substantially free of contamination by the dispersion solvent.

It is preferable to employ for the dispersion polymerization process a solvent in which the resin particles are not soluble. For example, it is preferable to employ a non-polar organic solvent having a low solubility parameter value such as paraffins, paraffinic esters, paraffinic amides and paraffinic ethers in combination with the polyester resin particles. The solubility parameter value of the organic medium is smaller or greater than the solubility parameter value of the macromer and the resulting particulate polymer resin by at least about 1, and more preferably by at least about 2.

Particularly preferred organic media for use in connection with the invention are paraffins. Examples of paraffins are normal and isoparaffins with 12 or more carbon atoms such as isoparaffinic mixtures sold under the trademark "Isopar®" by Exxon Chemical Company, Houston, Tex. Grades and their carbon numbers are as follows: Isopar® H C11–12; Isopar® K C11–12; Isopar® L C11–13; Isopar® M C13–14; and Isopar® V C12–40. Also suitable for organic media to be utilized in the polymerization process of the present invention are mineral oils which are mixtures of paraffins.

A surfactant is used in conjunction with the aforementioned non-polar solvent in the polymerization operation of this invention. The surfactant performs two important functions. First, it prevents coalescence of the resin particles during the polymerization reaction. In the inventive process, polymerization is carried out generally at a temperature higher than the glass transition temperature of resin. Thus, in the absence of the surfactant, the particles are in the molten state and tend to coalesce in an uncontrollable manner, producing particles that are unsuitable as a high-resolution toner. Secondly, the amount of surfactant directly controls the mean diameter of the resulting toner particles. The surfactant may be anionic, cationic or non-ionic. It is preferable that the surfactant is non-ionic and polymeric.

The weight ratio of the surfactant to the weight of the toner particle in the reactor can be selected as desired depending on the desired mean particle size. However, generally it is preferable that the amount of the surfactant is in the range of 0.5 to 20 parts by weight to 100 parts by weight of the resulting toner particle. From about 2 to about 8 parts by weight of surfactant is somewhat typical, based on the weight of toner. The ratio of total liquid medium in the dye bath to the toner particles to be produced can be selected as desired. However, generally it is preferable that the amount of the solvent is in the range of 50 to 1000 parts by weight to 100 parts by weight of the toner particles to be produced.

Examples of useful classes of polymeric, non-ionic surfactants include block copolymers of ethylene oxide and propylene oxide, condensation products of ethylene oxide with the product resulting from the reaction of propylene oxide and ethylenediamine, condensation products of propylene oxide with product of the reaction of ethylene oxide and ethylenediamine, copolymers of vinylpyrrolidones and alkyloxylated copolymers of maleic acid. Particularly useful surfactants include the various copolymers of vinyl pyrrolidone. A particularly preferred surfactant for use in the connection with the present invention includes Ganex® V220, a surfactant available from International Specialty Products which is eicosene-substituted vinyl pyrrolidone.

While specific non-limiting examples are provided herein below, a general methodology for producing small resin particles substantially free of oil contamination by the dispersion polymerization process of the invention is now described. 100 parts by weight of a 1:2 mixture of Isopar® V and L, 100 parts by weight of coarse macromer particles (without added pigment or colorant) and about 5 parts weight of Ganex® V220 are intermixed in a reactor equipped with a high speed stirrer and an overhead cooling column. The temperature of the reactor is increased to about 150° C. or higher and the reactant is maintained at that temperature under conditions of vigorous shearing. The coarse resin particles are in the molten state and the shearing break the molten particles into fine droplets. After about 10 to 30 minutes of shearing, the reaction mixture becomes milky in appearance. The temperature is then raised to about 220° C. at which temperature the dispersion oil starts boiling. Temperature of the cooling column is controlled in such a way that vapor of the boiling dispersion oil is completely condensed and returned to the reactor while the glycol vapor produced by the polymerization leaves the reactor and is collected as a condensate. When the collected condensate reaches a specified amount, the reactant is cooled down to terminate the polymerization. The reactant is cooled down to ambient temperature and the toner particles are separated from the dispersion solvent by filtration. Entrained solvent between particles is washed off with a light hydrocarbon such as isohexane and the washed particles are vacuum dried at about 40° C. to obtain dry toner particles.

Another embodiment of the invention is a method for producing a dyed particulate toner by the "after-dyeing" of dispersion polymerized functionalized macromers, using a subsequent dispersion dyeing process. More particularly, small toner particles comprising dyes and CCA, and that are substantially free of contamination, are produced by dispersion-dyeing of small resin particles produced by the dispersion polymerization of functionalized macromers. A method of dispersion dyeing small particles of an amorphous polymer resin is disclosed in pending application Ser. No. 09/457,543. In general, using the method set forth in the '543 application, the dyed toner of the present invention is produced as follows. First, small resin particles substantially free of contamination obtained by dispersion polymerization of functionalized macromer are prepared as described in the preceding paragraph. Next a bath comprising a mixture of an organic solvent, which does not dissolve the resin or the dye, and a surface active agent is prepared. The dye is dispersed in the bath, followed by dispersing the resin particles containing dye-receptive functional groups in the same. The dye is also characterized by having functional groups capable of forming a complex with the functionalized resin. The dispersion is maintained at an elevated temperature until the dye is substantially absorbed in the resin particles. The organic solvent is removed from the dispersion, whereupon the dye and the resin particles, having a mutual complexing affinity for each other through their respective functional groups, form a complex through ionic or covalent bond formation to yield a dyed toner particle.

Moreover, it is preferable to operate the inventive process at relatively high solids content wherein the polymer resin is present in an amount of from about 10 to about 70 volume percent of the combined volume of resin and organic medium during dyeing. In certain embodiments, a solid content about 20 to about 40 volume percent resin is more preferred.

In the present invention, it is preferable that the small resin particles produced by the dispersion polymerization of macromer have a volume average particle size (L) in the range 1–15 $\mu$m. The terms "volume average particle size" is defined in, for example, Powder Technology Handbook, 2nd edition, by K. Gotoh et al, Marcell Dekker Publications (1997), pages 3–13. More specifically, it is preferable to produce resin particles which include resin particles with a particle size distribution in the range of 0.5×L to 1.5×L in an amount of 80 wt. % or more of the entire weight of the resin particles. This is because the resin particles with such a narrow particle size distribution provide toner particles which are uniformly dyed, have uniform quantity of electric charge in each toner particle, provide high-quality copy images, and for which charge control is easy in a development unit.

The advantage of these resin particles is that they can be directly dyed by appropriately reacting the pendant functionalities on the polymer with appropriate coloring reagents. The coloring reagent is typically a dye which may be a basic dye, acid dye, reactive dye and combinations thereof. Basic dyes are cationic molecules that ionically bind to anionic sites. Acid dyes are anionic molecules which bind to cationic or basic sites, while reactive dyes are functional molecules which contain groups that covalently bind to sites such as, for example, —OH, —SH or —NRH in order to form respectively an ether, thioether or amine linkages.

The weight ratio of the dye to the resin to be dyed can be selected as desired, depending upon the desired color tone. However, generally it is preferable that the amount of the dye is in the range of 1 to 10 parts by weight to 100 parts by weight of the resin particles to be dyed.

For the dyeing operation, it is preferable to employ a solvent in which the resin particles are not soluble. More specifically, it is preferable that the solubility parameter value of the solvents is smaller than that of the resin particles by 1.0 or more, more preferably 2.0 or more. For example, it is preferable to employ a non-polar organic solvent having a low solubility parameter value such as paraffins, paraffinic esters, paraffinic amides and paraffinic ethers in combination with the polyester resin particles. In contrast, when a highly polar solvent such as water, methanol, propanol, and acetone is employed for the dyeing process, significant coalescence of the particles occurs.

Particularly preferred organic media for use in connection with the invention are paraffins. Examples of paraffins are normal and isoparaffins with 7 or more carbon atoms such as: octane, decane, dodecane, and isoparaffinic mixtures sold under the trademark "Isopar®" by Exxon Chemical Company, Houston, Tex. Grades and their carbon numbers are as follows: Isopar® C C7-8; Isopar®E, C8-9; Isopar® G C10-11; Isopar® H C11-12; Isopar® K C11-12; Isopar® L C11-13; Isopar® M C13-14; and Isopar® V C12-40. These Isopars® are manufactured by distillation and each designation refers to the take off positions of a distillation column. Also suitable as organic media for the dyeing process are mineral oils which are mixtures of paraffins. Paraffinic esters, such as dodecyl acetate, and paraffinic amines such as decylamine may also be employed.

A surfactant is used in conjunction with the aforementioned non-polar solvent in the dyeing operation of this invention. The surfactant performs two important functions for successful dyeing of the particles. First, it prevents coalescence of the resin particles during the dyeing reaction. In the inventive process, dyeing is carried out generally at a temperature higher than the glass transition temperature of resin. Thus, in the absence of the surfactant, when the particles are in the molten state, they tend to coalesce in an uncontrollable manner and produce dyed particles which are unsuitable as a high-resolution toner. Secondly, the functional dyes employed in the present invention are generally insoluble in non-polar solvents and a means of delivering the dye molecules to the resin particles does not exist in the absence of the surfactant. The surfactant, having polar sites in its molecular structure and thus some ability to solubilize the dye, plays an important role of transporting dye molecules from the dye particles to the resin particles and thus enabling the dyeing without a substantial particle agglomeration. This is the case even when the amount of resin to the solvent is as high as 100 parts by weight to 100 parts by weight of the total liquid medium in dye bath. The surfactant may be anionic, cationic or non-ionic. It is preferable that the surfactant is non-ionic.

The weight ratio of the surfactant to the non-polar solvent can be selected as desired depending on the amount of the resin particle to be dyed and the required processing time. However, generally it is preferable that the amount of the surfactant is in the range of 5 to 200 parts by weight to 100 parts by weight of the non-polar solvent. From about 10 to about 40 percent by weight of surfactant is somewhat typical, based on the weight of solution. The amount of the total liquid medium in the dye bath to the resin to be dyed can be selected as desired. However, generally it is preferable that the amount of the solvent is in the range of 50 to 1000 parts by weight to 100 parts by weight of the resin particles to be dyed.

Examples of useful classes of non-ionic surfactants include alkylphenol ethoxylates, aliphatic alcohol ethoxylates, fatty acid alkoxylates, fatty alcohol alkoxylates, block copolymers of ethylene oxide and propylene oxide, condensation products of ethylene oxide with the product resulting from the reaction of propylene oxide and ethylenediamine, and condensation products of propylene oxide with product of the reaction of ethylene oxide and ethylenediamine. Particularly useful surfactants include the reaction product of a fatty acid or a fatty alcohol with ethylene oxide such as a polyethylene glycol diester of a fatty acid (PEG diols or PEG diesters). A particularly preferred surfactant for use in the connection with the present invention includes Genapol®-26-L-1 surfactant available from Clariant Corporation which has the chemical structure of $C_{13}H_{27}—C_6H_4—(—CH_2—CH_2—O—)—CH_2—CH_2—OH$.

According to one embodiment for producing toner particles, dyeing is carried out by dispersing an appropriate functional dye in the above-mentioned mixture of a non-polar solvent and a surfactant, then dispersing the resin particles therein. The dispersion is stirred under conditions such that the temperature of the dispersion is kept at about 30° C. or higher than the glass transition temperature of the resin. The high temperature ensures that the penetration rate of the dye into the resin particles is sufficiently high that dyed resin particles can be obtained in about 5 minutes to about 60 minutes. The dispersion of the dye and resin particles is subjected to agitating means such as by a conventional stirrer, e.g., a blade-type mixer or a magnetic stirrer, to assist in dye penetration of the resin particles.

In the above-mentioned processes, dyed slurry is obtained. Dyed resin particles can be obtained from the slurry by any conventional methods. For example, dyed resin particles are separated from the slurry by filtration. The non-solvent and the surfactant are entrained in the filter cake and they are washed with a low boiling hydrocarbon such as n-pentane, n-hexane, isohexane and the like. It is important not to use a polar organic solvent such as methanol, propanol or isobutanol for the washing step since the cake tends to agglomerate upon exposure to such a solvent. The washed particles are then dried at a temperature below the glass transition temperature of the resin, or under reduced pressure. The thus obtained toner particles have substantially the same particle size distribution as that of the original resin particles.

The triboelectric charging characteristics of the present dye-containing toner is improved by the incorporation of a charge control agent ("CCA") into the toner particles. A CCA is dissolved in an organic solvent mixture that will not cause agglomeration of the dyed resin particles during CCA application. The dyed resin particles are immersed in the CCA solution at an elevated temperature conducive for diffusion of the CCA into the central portion of the particles. Alternatively, the CCA solution is sprayed onto the dyed particles. Subsequently, the organic solvent is removed by drying, while the CCA remains in the central portion of the toner particles or on the surface of thereof, respectively. It is preferable that the solvent mixture used for the CCA application be the same solvent mixture used in the aforementioned dyeing process.

It is preferable that the amount of the CCA is 0.1 to 10 parts by weight to 100 parts by weight of the dyed resin particles for appropriately controlling the triboelectric charging characteristics of the toner particles and image fixing performance. However, the ratio of CCA to dyed resin particles can be varied, depending upon the charge quantity required for the toner particles or the development means for use with the toner particles.

The pigmented or dyed toner particles of the present invention may further include a flowability improvement agent which is coated on the dyed resin particles. This treatment helps to enhance the flowability of the particles during use as a color toner. Suitable flow agents are materials such as finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyldisilazane and available under the trademark Cab-O-Sil® T-530 from Cabot Corporation, Tuscola, Ill.) is mixed with the CCA-coated particles and blended well in a tumble mixer for about 10–60 minutes to produce flow agent-coated toner particles.

In many color toner applications, the toner particles are used as a developer which typically contains the particles as described above (containing the CCA and the flow agent) and a suitable carrier agent (such as, for example, ferrites, steel, iron powder and the like, optionally containing a surface treating coating agent thereon). The dyed particles and the carrier are mixed together intimately to form the developer.

Throughout the present disclosure, there are several instances of important, if not essential, measured parameters, e.g., size, molecular weight, glass transition temperature. The following methods and/or instrumentation are utilized to assess the values. The particle size distribution of the resin particles is measured using a commercially available Coulter LS Particle Size Analyzer (made by Coulter Electronics Co., Ltd., St. Petersburg, Fla.).

The glass transition temperature is measured using a commercially available differential scanning calorimeter (DSC) apparatus (910 Differential Scanning Calorimeter available from E. I. DuPont Corporation, Wilmington, Del.).

The molecular weight distribution of resins is determined by gel permeation chromatography (GPC) using tetrahydrofuran as solvent, polystyrene as molecular weight standard with a GPC apparatus and columns (Alliance® GPC 2000 System and Styragel® GPC Columns available from Waters Corporation, Milford, Mass.).

The amount of residual dispersion solvent in the finished toner is determined using the following method. First, about 50 mg of the toner is dissolved in 2 ml of methylene chloride and the dissolved polymer is precipitated by adding 4 ml of heptane dropwise. The solution is then filtered and diluted to 10 ml with heptane and analyzed by gas chromatography (Hewlett-Packard Gas Chromatography with HP-1 column, available from Hewlett Packard Corporation, Palo Alto, Calif.).

Two different methods are used to assess the optical absorption density of the toners. In the first method, the toner is dissolved in hexafluoroisopropanol at a concentration of 1 g per liter of the solvent and the absorbance of the solution is determined in the double beam configuration using a Lambda-19 spectrophotometer (available from Perkin Elmer Corporation, Norwalk, Conn.). The solution absorbance (A) is defined as the logarithm of the ratio of intensities of incoming and outgoing optical beams when the path length through the solution is 1 cm.

In the second method, a solid image is printed on a polyester transparency film with a toner using a commercial color laser printer (DocuPrint® C55 available from Xerox Corporation, Rochester, N.Y.). The optical absorption density of the printed toner film is determined using the Lambda-19 spectrophotometer. The image color density (B) per unit thickness is determined by dividing the optical absorption density by the film thickness. The image density and the solution absorbance are related through the formula;

$$B=A^*(\rho^*d'/c^*d)$$

where c is the toner concentration (in grams per liter) in the solution, d' is the film thickness (in microns), ρ is the density of the toner resin (=1.2 g/cm3) and d is the path length through the solution (in centimeters). Numerically, the formula then becomes, $$B(\mu m^{-1})=0.12^*A(cm^{-1}).$$

The features of the present invention will become apparent in the course of the following description of examples, which are given for illustration of the invention and are not intended to be limiting thereof.

EXAMPLES

Example 1

Preparation of a Polyester Macromer

A polyester macromer was prepared by a melt condensation process as follows. Into a 10-liter glass reaction vessel fitted with a paddle stirrer and a 30 cm fractionating column, dimethyl terephthalate (5 moles, 970 gr), dimethyl isophthalate (4.7 moles, 912 gr), sodium salt of dimethyl 5-sulfoisophthalate (0.3 moles, 88 gr), and 1-methylethylene glycol (20 moles, 1520 gr) were charged. Dibutyl tin oxide (10.5 gr) was added as the ester exchange catalyst. The reactants were charged at ambient temperature and purged with argon gas for about 1 hour. The reaction mixture was then heated to 150° C. with the stirrer on at 50 rpm to form a homogeneous melt. Subsequently, the reaction mixture was heated from 150° C. to 200° C. under a flowing argon atmosphere over 4 hours and maintained at 200° C. until approximately 800 ml of distillate was collected.

The reaction mixture was brought up to 230° C. over about 30 minutes and was maintained at this temperature for one hour with agitation of 50 rpm. The agitator speed was then lowered to 30 rpm and the reactor put under a vacuum of 0.5 torr. The reaction mixture was maintained under these conditions until approximately 680 gr of distillate was collected. Subsequently, the vacuum was released with argon and the reactant cooled downed to about 150° C. The contents of the reactor was poured onto a glass plate and allowed to cool down to ambient temperature. Approximately 2100 gr of macromer was obtained.

The glass transition of the thus prepared macromer is 48° C. The glass transition temperature is measured by use of a commercially available differential scanning calorimeter (DSC) apparatus (910 Differential Scanning Calorimeter available from E. I. DuPont Corporation, Wilmington, Del.). The number average molecular weight of the polyester macromer is 1980 and the weight average molecular weight 4750, producing a polydispersity of 2.4. The molecular weights are determined by gel permeation chromatography (GPC) using tetrahydrofuran as solvent, polystyrene as the molecular weight standard with a GPC apparatus and columns (such as Alliance® GPC 2000 System and Styragel® GPC Columns available from Waters Corporation, Milford, Mass.).

Example 2

Cyan Pigmented Toner by Dispersion Polymerization of Polyester Macromer

C. I. Pigment Blue 15:3 having a Color Index Constitution Number 74160 (Heliogen™ Blue D7100 obtainable from BASF Corp., Charlotte, N.C.) and a negative charge control agent (Bontron™ E-88 available from Orient Chemical Corporation, Springfield, N.J.) were dispersed in the polyester macromer of Example 1 as follows. In an laboratory mixer (from Aaron Process Company) equipped with a two horsepower direct connect gear motor and mixing blades of sigma design with front blade speed set at 60 RPM and back blade speed set at 34 RPM, 500 grams of the polyester resin was charged and heated to 140° C. until the resin was completely molten and freely flowing. C. I. Pigment Blue 15:3 particles were added in three aliquots to the molten resin. A total of 25 grams of C. I. Pigment Blue 15:3 was added to the resin. 5 grams of Bontron E-88 charge control agent (CCA) was added to the resin/pigment mixture. The mixture of resin/pigment/CCA was further mixed for one hour at 140° C. The mixture was then cooled and pulverized in a ball mill (available from Paul O. Abbe, Inc., N.J.) to form coarse particles with a number averaged size of approximately 70 microns.

Into a 2000-ml round-bottom flask equipped with an impeller-type agitator and a 20-cm column, 500 grams of 1:2 mixture of Isopar L and P, 12.5 grams of Ganex V-220 and 500 grams of the above coarse particles were charged. The mixture was then heated to 150° C. under argon purge and maintained at the temperature for 60 minutes under agitation at 500 rpm until the mixture formed a milky dispersion. The dispersion was then heated to about 220° C. when the Isopar mixture starts boiling. Temperature of the column was controlled to return oil condensate back to the reactor and the glycol moiety resulting from polymerization goes over. The glycol is condensed and collected. After one hour of polymerization under prevailing conditions, the reaction mixture was then cooled to ambient temperature. The toner particles were separated from the dispersion solvent by filtration. The entrained solvent in the filter cake was washed off by dispersing the filter cake in isohexane and filtering again. The filtered particles were dried at 40° C. under vacuum for 16 hours. 100 parts by weight of the dry particles were blended with 1 part by weight of Cab-O-Sil® TG-308F (a fumed silica flowability improvement aid from Cabot Corporation, Tuscola, Ill.) for 15 minute in a roll mill, whereby cyan toner No. 1 according to the present invention was obtained.

The resulting cyan toner contains 93.2 wt. percent of the polyester resin, 5.0 wt. percent of C. I. Pigment Blue 15:3, 1.0 wt. percent of Bontron E-88 and 0.8 wt. percent of the flowability improvement agent. The toner contains less than 0.2 wt. percent of the dispersion solvent when the solvent content is determined by mass spectroscopy. Particle size determination revealed the number average particle size is significantly reduced to 4.2 microns. Scanning electron microscopy examination of the toner particles shows that the toner particles are spherical, have smooth surface texture, and have silica particles attached to the outer surface.

Example 3

Preparation of a Cyan Toner by Dispersion-dyeing Resin Particles Produced by Dispersion Polymerization of Macromer Into a 2000-ml round-bottom flask equipped with an impeller-type agitator and a 20-cm column, 500 grams of 1:1 mixture of Isopar L and P, and 12.5 grams of Ganex V-220 were charged. The mixture was heated to 150° C. 500 gr of the macromer of Example 1 was made molten by heating it to 90° C. and was slowly added to the dispersion medium. The reaction mixture was then purged with argon. The mixture was heated from 150° C. to 195° C. over 50 minutes under high-speed agitation at 500 rpm. The reaction mixture became opaque and milky at about 195° C. and was maintained at this temperature for 60 minutes. The dispersion was then heated to about 215° C. at which temperature the Isopar mixture starts boiling. Temperature of the column was controlled to return oil condensate back to the reactor and the glycol moiety resulting from polymerization goes over. The glycol was condensed and collected. After one hour of polymerization under the prevailing conditions, the reaction mixture was cooled to ambient temperature. The white resin particles were separated from the dispersion solvent by filtration, and the entrained solvent in the filter cake washed off by dispersing the filter cake in isohexane and filtering again. The filtered particles were dried at 40° C. under vacuum for 16 hours three times.

The yield of polymer particles after drying was 458 gr. The glass transition temperature was 57° C., and the median particle size was 4.0 microns with a distribution size of 10% of particles being 0.71 microns and 90% being 6.68 microns as measured by laser light scattering. Scanning electron microscopy showed that the particles were almost all completely spherical.

Into a 500-ml round-bottom flask equipped with a blade-type agitator, 144 g of Isopar-L®, 24 g of Genapol® 26-L-1 and 144 g of the above dispersion polymerized particles were charged. The mixture was then heated to 90° C. and maintained at that temperature for 30 minutes under agitation at 100 rpm. 1.73 g of Astrazon® Blue BG 200 (a CI Basic Blue 3 dye available from DyStar L. P., Charlotte, N.C.) is added to the reaction mixture. The dyeing reaction mixture was maintained at 90° C. for 60 minutes.

Subsequently, 1.4 g of Bontron® E-84 (a negative charging charge control agent based on a zinc salt, available from Orient Chemical Corporation of America, Springfield, N.J.) was added into the dyeing reaction mixture. The reaction mixture was maintained at 90° C. for additional 30 minutes to effect diffusion of the charge control agent into the particles and the reaction was cooled to ambient temperature. The treated particles were separated from the reaction mixture by filtration, and the entrained solvent in the filter cake washed off by dispersing the filter cake in isohexane and filtering again. The filtered particles were dried at 40° C. under vacuum for 16 hours.

100 parts by weight of the dry dyed particles were blended with 1 parts by weight of Cab-O-Sil® TG-308F for 15 minute in a roll mill, whereby toner No. 2 according to the present invention was obtained.

The resulting cyan toner contains 96.7 wt. percent of the polyester resin, 1.2 wt. percent of Astrazon Blue BG 200 dye, 1.0 wt. percent of Bontron E-88 and 0.9 wt. percent of the flowability improvement agent. The toner contains less than 0.2 wt. percent of the dispersion solvent when the solvent content is determined by the gas spectroscopy means. Particle size determination revealed the average particle size is essentially unchanged at 4.1 microns. Scanning electron microscopy examination of the toner particles shows that the particles are spherical, have smooth surface texture and have silica particles attached to the outer surface.

Example 4

(Comparative) Preparation of a Cyan Toner by Dyeing Resin Particles Produced by a Dispersion Polymerization of Polyester Monomer A polyester monomer was prepared by an ester exchange reaction. Into a 10-liter glass reaction vessel fitted with a paddle stirrer and a 30 cm fractionating column, dimethyl terephthalate (5 moles, 970 gr), dimethyl isophthalate (4.7 moles, 912 gr), sodium salt of dimethyl 5-sulfoisophthalate (0.3 moles, 88 gr), and 1-methyl-ethylene glycol (20 moles, 1520 gr) were charged. Dibutyl tin oxide (10.5 gr) was added as the ester exchange catalyst. The reactants were charged to the reaction vessel at ambient temperature and purged with argon gas for about 1 hour. The reactant mixture was then heated to 150° C. with the stirrer on at 50 rpm to form a homogeneous melt. Subsequently, the reaction mixture was heated from 150° C. to 200° C. under a flowing argon atmosphere over 4 hours and maintained at 200° C. until approximately 800 ml of distillate was collected. The reaction mixture was then cooled to ambient temperature. About 2800 gr of waxy solid was obtained.

Into a 2000-ml round-bottom flask equipped with an impeller-type agitator and a 20-cm column, 500 grams of 1:1 mixture of Isopar L and P, and 12.5 grams of Ganex V-220 were charged. The mixture was then heated to 150° C. 690 gr of the above polyester monomer was made molten by heating it to 90° C. and was slowly added to the dispersion medium. The reactor was purged with argon. The mixture was heated from 150° C. to 195° C. over 50 minutes under high-speed agitation at 500 rpm. The reaction mixture became opaque and milky at about 195° C. and was maintained at that temperature for 60 minutes. The dispersion was then heated to about 215° C. at which temperature the Isopar mixture starts boiling. Temperature of the column was controlled to return oil condensate back to the reactor and the glycol moiety resulting from polymerization goes over. The glycol was condensed and collected. After one hour of polymerization under the prevailing condition, the reactant was cooled to ambient temperature. The white resin particles were separated from the dispersion solvent by filtration, and the entrained solvent in the filter cake was washed off by dispersing the filter cake in isohexane and filtering again. The filtered particles were dried at 40° C. under vacuum for 16 hours three times.

The yield of polymer particles after drying was 510 gr. The glass transition temperature was 58° C., and the median particle size was 4.3 microns with 10% of particles being 0.76 microns and 90% of particles being 7.0 microns as measured by laser light scattering. Scanning electron microscopy showed that the particles were spherical and contained capillary-like defects.

150 gr of the above resin particles produced by dispersion polymerization of the polyester monomer were dyed with 1.8 g of Astrazon® Blue BG 200 dye and treated with Bontron® E-84 employing the same method of Example 3. The particles were dried under the same condition as in Example 3. 100 parts by weight of the dyed particles were blended with 1 part by weight of Cab-O-Sil® TG-308F for 15 minute in a roll mill, whereby a comparative example toner was obtained.

The resulting cyan toner contains 91.4 wt. percent of the polyester resin, 1.1 wt. percent of Astrazon Blue BG 200 dye, 0.95 wt. percent of Bontron E-88 and 0.85 wt. percent of the flowability improvement agent. The toner contains 5.7 wt. percent of the dispersion solvent when the solvent content is determined by the gas spectroscopy means. Particle size determination revealed that the average particle size is essentially unchanged at 4.1 microns. Scanning electron microscopy examination of the toner particles showed that the particles were spherical, contained silica particles attached on their surface, but further contained capillary-like defects.

Example 5

Toner Evaluation

The triboelectric charge of the toners described above is determined by a blow-off type electric charge measuring apparatus (Vertex Charge Analyzer supplied by Vertex Image Products, Yukon, Pa.) equipped with a Faraday cage and an electrometer as described below. First, a developer is prepared by blending a toner and a carrier (Type 22 Carrier, copper-zinc ferrite granules coated with a fluoropolymer, supplied by Vertex Image Products) at a ratio of about 2 parts by weight of toner to 100 parts by weight of the carrier. The developer is placed in a glass jar and rolled at 10 rpm for 10 minutes using a roll mill. Approximately 1.5 g of the rolled developer is placed in a Faraday cage and the toner particles are blown out of the Faraday cage using an air stream from a nozzle. The up-stream air pressure is typically about 80 k-newton/$m^2$. Charge induced on the Faraday cage due to blowing-off of charged toner particles for 60 seconds is defined as the toner charge. The charge per unit mass of toner is obtained by dividing the toner charge by the amount of toner blown-off the Faraday cage.

The optical absorption density of the toners was assessed using the two methods previously described in the disclosure immediately preceding the examples. The results are shown in the following table, along with the wt. % contamination from the dispersion solvent used in the dispersion polymerization and/or dispersioning processes.

| Toner | Charge ($\mu$C/g) | Solution absorb. ($cm^{-1}$) | Color | Image color density ($\mu m^{-1}$) | Oil content (wt. %) |
|---|---|---|---|---|---|
| No. 1 (Example 2) | −35 | 4.7 | Dark, turbid blue | 0.15 | <0.2 |
| No. 2 (Example 3) | −41 | 1.9 | Clear blue | 0.24 | <0.2 |
| Comparative toner (Example 4) | −40 | 1.7 | Clear blue | 0.21 | 5.7 |

The results shown in the above table indicate that the toners according to the invention provide higher image density as compared to the comparative toner. The reason being that the resin particles for the inventive toners are dyed to a higher dye concentration due to the chemical affinity between the resin containing functionalized sites and the functional dyes. The results also show that the toners according to the invention contain a substantially negligible amount of dispersion oil contamination as compared to the comparative toner. The reason being that the volume contraction accompanying the polymerization of the polyester macromer is substantially smaller than that accompanying the polymerization of conventional monomer. Moreover, printed images using the toners of the present invention are clear, while the comparative toner produced "foggy" printed images.

The invention has been described in detail in connection with numerous embodiments and non-limiting examples. However, modifications will be readily apparent to those of skill in the art. For example, while the inventive process has been described in connection with a paraffin solvent, other solvents which are stable under required operating temperatures and which possess suitable solubility parameter may be substituted. Such modifications are within the spirit and scope of the present invention which is set forth in the appended claims.

What is claimed is:

1. A process for preparing polymeric resin particles suitable for toner applications comprising subjecting a macromer to dispersion polymerization in a liquid organic medium in the presence of a dispersion stabilizing surfactant, said macromer being a polyester i) containing functional moieties present from about 0 to about 10 mole percent based on macromer and capable of interacting with a colorant having reactive functional groups, ii) having the number average degree of polymerization in the range of about 5 to about 20 and iii) being substantially insoluble in said organic medium, and isolating said polymeric particles from said organic medium, whereby the polymeric resin particles formed are substantially free of contamination from said organic medium.

2. The process according to claim 1 comprising the steps of a) forming a dispersion of fine droplets of the macromer in the liquid organic medium in the presence of the dispersion stabilizing surfactant;

b) maintaining the liquid organic medium containing said fine droplets of macromer at an elevated temperature for a time sufficient to polymerize said macromer;

c) cooling said liquid organic medium containing polymerized macromer thereby forming dispersed polymeric resin particles; and d) separating said liquid organic medium from said polymeric resin particles.

3. The process according to claim 2 wherein step a) comprises subjecting the macromer in the liquid organic medium to a temperature substantially higher than the glass transition temperature of said macromer under vigorous shearing action to form a fine particle dispersion of macromer, step b) comprises elevating said temperature of said fine particle dispersion to about 200° C. to about 250° C. under vigorous shearing action for a period of time sufficient to polymerize said macromer to a molecular weight suitable for making a toner, and step c) comprises cooling said liquid organic medium containing polymerized macromer to a temperature below the glass transition temperature of said macromer.

4. The process according to claim 3, wherein said fine particle dispersion in step b) is subjected to elevated temperature and vigorous shearing action for about 5 minutes to about 180 minutes.

5. Polymeric resin particles formed according to the process of claim 1 characterized as being substantially spherical in shape, and having a volume average diameter in the range of 1–10 $\mu$m with at least 95 percent of said polymeric resin particles having a diameter in the range of 2–15 $\mu$m.

6. The polymeric resin particles according to claim 5, wherein said resin particles contain less than about 2 percent by weight of entrapped liquid organic medium used in dispersion polymerization.

7. The process according to claim 1 wherein said macromer subjected to dispersion polymerization is a polyester functionalized with moieties selected from the group consisting of hydroxy moieties, alkoxy moieties, sulfonic or derivatized sulfonic moieties, sulfinic or derivatized sulfinic moieties, carboxyl or derivatized carboxyl moieties, phosphonic or derivatized phosphonic moieties, phosphinic or derivatized phosphinic moieties, thiol moieties, amine moieties, alkaline moieties, quaternized amine moieties, and mixtures thereof.

8. The process according to claim 1 further characterized by subjecting said macromer to dispersion polymerization in a liquid organic medium comprising a solvent having a solubility parameter value that is larger or smaller by an increment of at least about 1 than the solubility parameter value of said polymeric resin particles formed.

9. The process according to claim 8 wherein the solubility parameter value of said solvent is smaller than the solubility parameter value of the polymeric resin particles formed by at least about 2.

10. The process according to claim 1, wherein said solvent comprises a paraffin, a paraffinic ester, a paraffinic amide, a paraffinic ether, or mixtures thereof.

11. The process according to claim 1 further characterized by subjecting said macromer to dispersion polymerization in a liquid organic medium in the presence of a dispersion stabilizing surfactant comprising an anionic, cationic, or non-ionic surfactant.

12. The process according to claim 11 wherein a polymeric non-ionic surfactant is used as the dispersion stabilizing surfactant.

13. The process according to claim 12 wherein said polymeric non-ionic surfactant contains a residue comprising a vinylpyrrolidone moiety or an alkylester of maleic acid moiety.

14. A process for preparing dispersion-dyed polymeric resin particles useful as a toner for developing latent electrostatic images prepared by a process comprising:

a) forming polymeric resin particles according to the process of claim 1, said particles having functional sites suitable for interacting with a dye having reactive functional groups;

b) dispersing said polymeric resin particles in a liquid organic medium, said polymeric particles being substantially insoluble in said liquid organic medium;

c) providing a functionalized dye to said dispersion of step b, said functionalized dye having functional groups adapted for interacting with the functional sites on said polymeric resin particles;

d) maintaining the dispersion of liquid organic medium containing said polymeric resin particles and said dye at an elevated temperature for a time sufficient to dye said particles;

e) cooling the dispersion of step d; and f) separating said liquid organic medium from said dyed polymeric resin particles;

whereby dyed toner particles are obtained being substantially free of contamination by said liquid organic medium.

15. The process according to claim 14, further comprising introducing a surfactant to said dispersion of polymeric resin particles of step b, and introducing a charge control agent to step c.

16. The process according to claim 15, wherein said surfactant is a non-ionic surfactant comprising alkylphenol ethoxylates, aliphatic alcohol ethoxylates, fatty acid alkoxylates, fatty alcohol alkoxylates, block copolymers of ethylene oxide and propylene oxide, condensation products of ethylene oxide with a reaction product of propylene oxide with ethylenediamine, condensation products of propylene oxide with a reaction product of ethylene oxide with ethylenediamine, or condensation products of a fatty acid or a fatty alcohol with ethylene oxide, is introduced to step b.

17. The process according to claim 16 wherein said non-ionic surfactant contains a residue of an ethylene oxide or propylene oxide moiety.

18. The process according to claim 15, wherein said surfactant is introduced in an amount of from about 5 to about 200 percent by weight based on 100 parts by weight of said liquid organic medium present in step a.

19. The process according to claim 18 wherein said dispersion stabilizing surfactant is introduced in an amount of from about 20 to about 40 parts by weight relative to 100 parts by weight of said liquid organic medium present in step b.

20. The process according to claim 15 wherein said charge control agent introduced in step c is present in an amount from about 0.1 to about 10 percent by weight of said dyed toner particles obtained.

21. The process according to claim 14 wherein said functionalized dye introduced in step c is introduced relative to said dyed toner particles obtained in a ratio of from about 1:100 to about 10:100.

22. The process according to claim 14, wherein said polymeric resin particles comprise from about 10 to about 70 volume percent of the combined volume of said resin particles and liquid organic medium during dyeing.

23. The process according to claim 22, wherein said polymeric resin particles comprise from about 20 to about 40 volume percent of the combined volume of said resin particles and liquid organic medium during dyeing.

24. The process according to claim 14, wherein step d is conducted at a temperature at least 20° C. below the glass transition temperature of said polymeric resin particles or higher.

25. The process according to claim 24, wherein step d is conducted at a temperature at least about 30° C. higher than the glass transition temperature of said polymeric resin particles.

26. The process according to claim 25, wherein said temperature is maintained for a period of from about 5 to about 60 minutes.

27. The process according to claim 24, wherein said temperature is maintained for a period of from about 5 to about 60 minutes.

28. A dispersion dyed particulate toner prepared according to the process of claim 15 having particle interiors containing less than about 2 percent by weight of liquid organic dispersion medium.

29. The dispersion dyed particulate toner according to claim 28 having particle interiors containing less than about 0.5 percent by weight of liquid organic dispersion medium.

30. The dispersion dyed particulate toner according to claim 28 further comprising an effective amount of one or more toner additives selected from the group consisting of flow enhancing aids and low molecular weight polypropylene and polyethylene waxes.

31. The dispersion dyed particulate toner according to claim 30 wherein said flow enhancing aid is a fumed silica.

32. A developer composition comprising a dispersion dyed particulate toner according to claim 30 and carrier particles, wherein said carrier particles are selected from the group consisting of ferrite, steel and iron powder optionally having a surface active agent coated thereon.

33. The dispersion dyed particulate toner according to claim 28, containing a dye comprising a cyan dye, a yellow dye, a magenta dye, a black dye, or mixtures thereof.

34. The dispersion dyed particulate toner according to claim 33, wherein said dye is present from about 0.5 to about 10 percent by weight of said dyed particulate toner.

35. The dispersion dyed particulate toner according to claim 28, wherein said particulate toner has a volume average particle size of from about 2 to about 10 microns.

36. The dispersion dyed particulate toner according to claim 28, wherein said particulate toner has a volume average particle size of from about 2 to about 4 microns.

37. The dispersion dyed particulate toner according to claim 28, wherein said particulate toner has a volume average particle size of from about 5 to about 8 microns.

38. The dispersion dyed particulate toner according to claim 28, where at least about 80% of toner particles are within from about 0.5 to about 1.5 times the volume average particle size of toner particles.

* * * * *